US005253420A

United States Patent [19]

Althaus et al.

[11] Patent Number: 5,253,420

[45] Date of Patent: Oct. 19, 1993

[54] RAZOR HEAD, ESPECIALLY RAZOR BLADE UNIT OF A WET RAZOR

[75] Inventors: Wolfgang Althaus, Wuppertal; Michael Schwarz, Herne, both of Fed. Rep. of Germany

[73] Assignee: Wilkinson Sword Gesellschaft mit beschränker Haftung, Solingen, Fed. Rep. of Germany

[21] Appl. No.: 906,218

[22] Filed: Jun. 25, 1992

[30] Foreign Application Priority Data

Jul. 3, 1991 [DE] Fed. Rep. of Germany ... 9108213[U]

[51] Int. Cl.[5] ..... B26B 21/00

[52] U.S. Cl. ..... 30/50; 30/47

[58] Field of Search ..... 30/50, 47, 77, 78, 79, 30/62, 51

[56] References Cited

U.S. PATENT DOCUMENTS

| | | | |
|---|---|---|---|
| 3,955,277 | 5/1976 | Pomfret | 30/50 |
| 3,972,114 | 8/1976 | Chao et al. | 30/50 |
| 4,063,354 | 12/1977 | Oldroyd et al. | 30/47 |
| 4,300,285 | 11/1981 | Endo | 30/47 |
| 4,347,663 | 9/1982 | Ullmo | 30/89 |
| 4,378,633 | 4/1983 | Jacobson | 30/50 |
| 4,442,598 | 4/1984 | Jacobson | 30/47 |
| 4,501,067 | 2/1985 | Duncan | 30/47 |
| 4,939,840 | 7/1990 | Butka | 30/51 |
| 5,070,612 | 12/1991 | Abatemarco | 30/50 |

FOREIGN PATENT DOCUMENTS

| | | |
|---|---|---|
| 0287387 | 10/1988 | European Pat. Off. . |
| 2444292 | 9/1974 | Fed. Rep. of Germany . |
| 2930478 | 7/1979 | Fed. Rep. of Germany . |
| 2938975 | 9/1979 | Fed. Rep. of Germany . |
| 3003132 | 1/1980 | Fed. Rep. of Germany . |

*Primary Examiner*—Frank T. Yost
*Assistant Examiner*—Hwei-Siu Payer
*Attorney, Agent, or Firm*—Robert W. Becker & Associates

[57] ABSTRACT

A razor head, especially a razor blade unit of a wet razor, disposed at the front end of a handle. A single or double razor blade is yieldingly mounted in a plastic housing. To improve the spring or yielding mounting of the single or double razor blades, the latter are secured to a blade member that is displaceably mounted in the plastic housing and can be displaced in a direction toward the rear wall of the plastic housing against a spring force.

13 Claims, 7 Drawing Sheets

7
14
13
3
8
12
9
5
8
6
6
14
2
4
4
9

RAZOR HEAD, ESPECIALLY RAZOR BLADE UNIT OF A WET RAZOR

BACKGROUND OF THE INVENTION

The present invention relates to a razor head, especially a razor blade unit of a wet or safety razor, with the razor head being disposed at the front end of a handle. A single or double razor blade is yieldingly disposed in a plastic housing.

It should be noted that if the razor is a disposable razor, a single or double razor blade is fixedly embedded in the razor head in a plastic housing. If the razor head is a separate component, and can be secured to a handle, for which purpose both the handle and the razor head have corresponding interlocking means, the arrangement is referred to as a so-called razor blade unit.

Pursuant to one known razor blade unit of a wet razor, a plastic housing having a forward guide strip is provided. To form a double razor blade, disposed within this plastic housing are two razor blades, each of which is separately yieldingly mounted. For this purpose, each of the two razor blades is disposed on a lateral spring tongue, thus making it possible for the razor blades to respectively adapt to the contour of a face during a shaving process. Unfortunately, a drawback of this known system is that the angle, and hence the position, of the razor blades does not remain constant while shaving. Thus, undesired oscillations or movements in the respective razor blades can occur, which can then result in an unsatisfactory shave.

It is therefore an object of the present invention to provide a razor head, and especially a razor blade unit of a wet razor, that has an improved spring or yielding mounting of the single or double razor blades.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
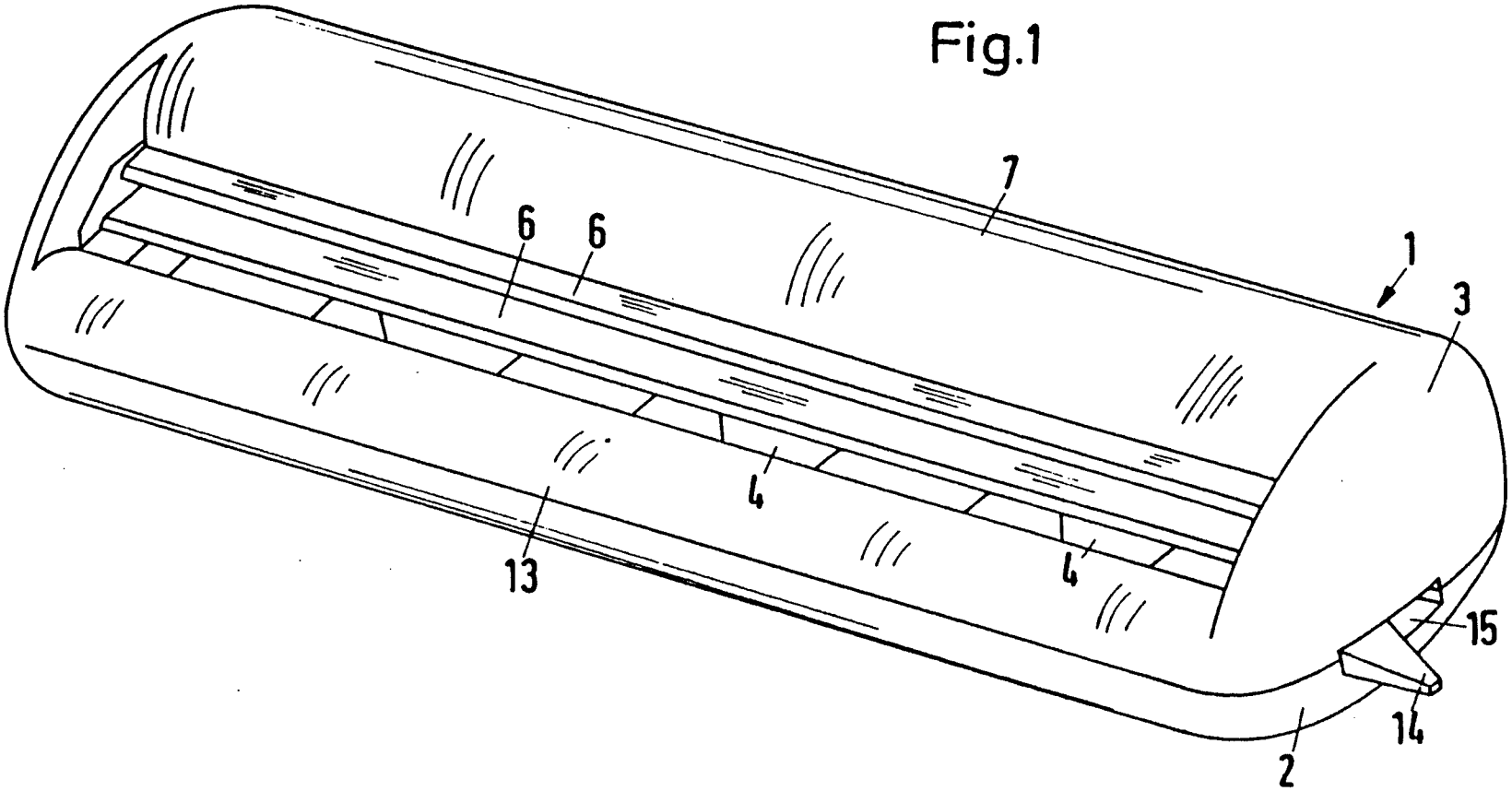
FIG. 1 is a perspective view of one exemplary embodiment of the inventive razor head, which is in the form of a so-called razor blade unit.

The razor head of the present invention is characterized primarily in that the blade means, which is in the form of a single or double razor blade is secured to a blade member that is mounted in the plastic housing in such a way that it can be displaced in a direction toward the rear wall of the plastic housing against a spring force.

A razor head, especially a razor blade unit of a wet razor, that is constructed pursuant to the teaching of the present invention so that it has a single or double razor blade secured to a blade member has the advantage of providing an improved spring or yielding mounting. For example, when a conventional double razor blade is used, the two individual razor blades, which are mounted so as to be parallel to one another, are displaceable in a parallel and hence synchronous manner. The significant advantage of this system is that the angle and hence the position of the razor blades does in fact remain constant while shaving, whereby undesired oscillations or movements in the blades are avoided due to the precise technical guidance, so that as a result an optimum shaving efficiency can be achieved. During the shaving process, with the aforementioned linear displacement, the razor blades remain at a constant angle to one another, which despite the spring or yielding mounting leads to the aforementioned very good shaving results. It is to be understood that the use of the expression linear guidance does not mean that the blade member carries out an exact linear movement with both the left side and the right side being simultaneously shifted in a direction toward the rear wall of the plastic housing; rather, the expression linear guidance also refers to a shifting of just one of the two ends of the blade member in a direction toward the rear wall of the plastic housing, in which case so to speak a pivoting movement is carried out in the plane of the razor blades, whereby the other end of the blade member forms a fulcrum. In summary, the movement of the blade member can be effected in a parallel or nonparallel manner. This offers the advantage that as a function of shaving forces that are applied, a slight deflection of the blade member is ensured. The blade member can be made of plastic or metal, and can be a single piece or several pieces. The razor blades are secured to the blade member in a way that resists the forces that occur during a shaving process, for example by being glued thereto, fused therewith, via a frictional connection, in an interlocking manner, or via rivets.

Pursuant to one preferred specific embodiment of the present invention, the blade member is displaceable parallel to the plane or planes of the razor blade or blades. In this way, a blade member is provided that is movable in a parallel and horizontal manner, with the razor blades that are secured to the blade member being displaceable toward the rear parallel to the face tangent at the preset starting angle. This results in an optimum shave with yieldingly mounted razor blades.

To achieve a precise guidance of the blade member, the displacement movement of the blade member is guided at the top by a cap or cover means of the plastic housing.

To provide an optimum spring or yielding mounting, it is proposed pursuant to the present invention that a compression spring be disposed between the blade member and the rear wall of the plastic housing. This compression spring, which is supported between the rear wall of the plastic housing and the blade member, ensures the necessary restoring or return force for the blade member.

The compression spring is preferably a curved leaf-type or wire spring. The spring can be made of plastic or metal, and is appropriately placed into the plastic housing such that it is supported between the rear wall of the plastic housing and the blade member. Pursuant to one specific embodiment of the present invention, the leaf-type or wire spring can have a number of curved portions over its length. In other words, one curved portion adjoins another, so that a number of contact points against the rear wall of the plastic housing on the one hand and against the blade member on the other hand are provided. One advantage of this arrangement is that pressure is uniformly applied over the length of the blade member. Another advantage is that the aforementioned displacement movements of one side or end of the blade member can be carried out.

As an alternative to the previously described arrangement, the return force for the blade member can also be applied by a resilient cam or projection that similarly ensures a yielding mounting of the blade member.

Pursuant to another preferred specific embodiment of the blade member, each end of the blade member is provided with a respective guide piece via which the blade member is displaceable in corresponding recesses in the plastic housing. As a consequence of such guide pieces or guide means, the system is provided with trouble-free guidance characteristics. In this connection, the guide pieces can be guided toward the outside through the plastic housing, especially through an upper blade shell. As a consequence, the operation of the blade member can be verified. In addition, it is also possible to shift the blade member toward the rear for purposes of cleaning.

Pursuant to one specific embodiment of the guide pieces of the blade member, it is proposed that these guide pieces be convexly curved toward the outside. In this connection, the curvature has such a form and purpose that it is therewith possible to have the displacement movement on one side in the manner of the previously described pivoting movement in the plane of the razor blades when force that is applied to one side or end of the blade member leads to a deflection movement at one end.

Pursuant to another specific embodiment of the inventive razor head, especially when it is in the form of a razor blade unit, it is proposed that the plastic housing comprise a lower portion and an upper portion that can be assembled together, with the blade member being disposed between these portions as a separate component. The advantage of such a construction is that the razor blade unit can be constructed in a technically straightforward manner and can also be easily assembled. The upper portion of the plastic housing preferably has a frame-like construction including a spaced-apart guide strip toward the front and a rear cap that are fixedly interconnected via side walls.

Pursuant to one specific embodiment of the lower portion of the plastic housing, this lower portion is provided with openings. This has the advantage that while shaving, shaving cream can be more easily removed, and furthermore cleaning of the razor blade unit is improved.

It is finally proposed pursuant to another specific embodiment of the present invention that the blade member have at least one projection that is guided outwardly through an opening in the plastic housing. The blade member preferably has a respective projection on each side, with these projections being guided outwardly through appropriate openings in the side walls of the plastic housing. By means of these projections, the blade member can be easily controlled or actuated from the outside, thereby considerably improving cleaning of the razor blades.

Further specific features of the present invention will be described in detail subsequently.

DESCRIPTION OF PREFERRED EMBODIMENTS

Referring now to the drawings in detail, the razor blade unit comprises a plastic housing 1 that is composed of a lower portion 2 and an upper portion 3. The base region of the lower portion 2 is provided with openings 4. The lower portion 2 and the upper portion 3 can be fixedly connected to one another by any suitable means, such as by being fused together glued together, interlocked together, telescoped in one another, etc.

A blade member 5 is displaceably mounted within the plastic housing 1. In the illustrated embodiment, the blade member 5 is provided with two razor blades 6 to form a double razor blade, with these blades being fixedly connected to the blade member 5. The blade member 5, together with its razor blades 6, is displaceably mounted on the base of the lower portion 2. On the top side, the blade member 5 is guided through a rear cap or cover means 7 of the upper portion 3 of the plastic housing 1. To provide further guidance, each side of the blade member 5 is provided with a respective guide piece 8 that is displaceably guided in a corresponding recess 9 in the plastic housing 1. As can be seen from FIG. 2, the two guide means 8 are sightly convexly curved toward the outside.

Figure 6:
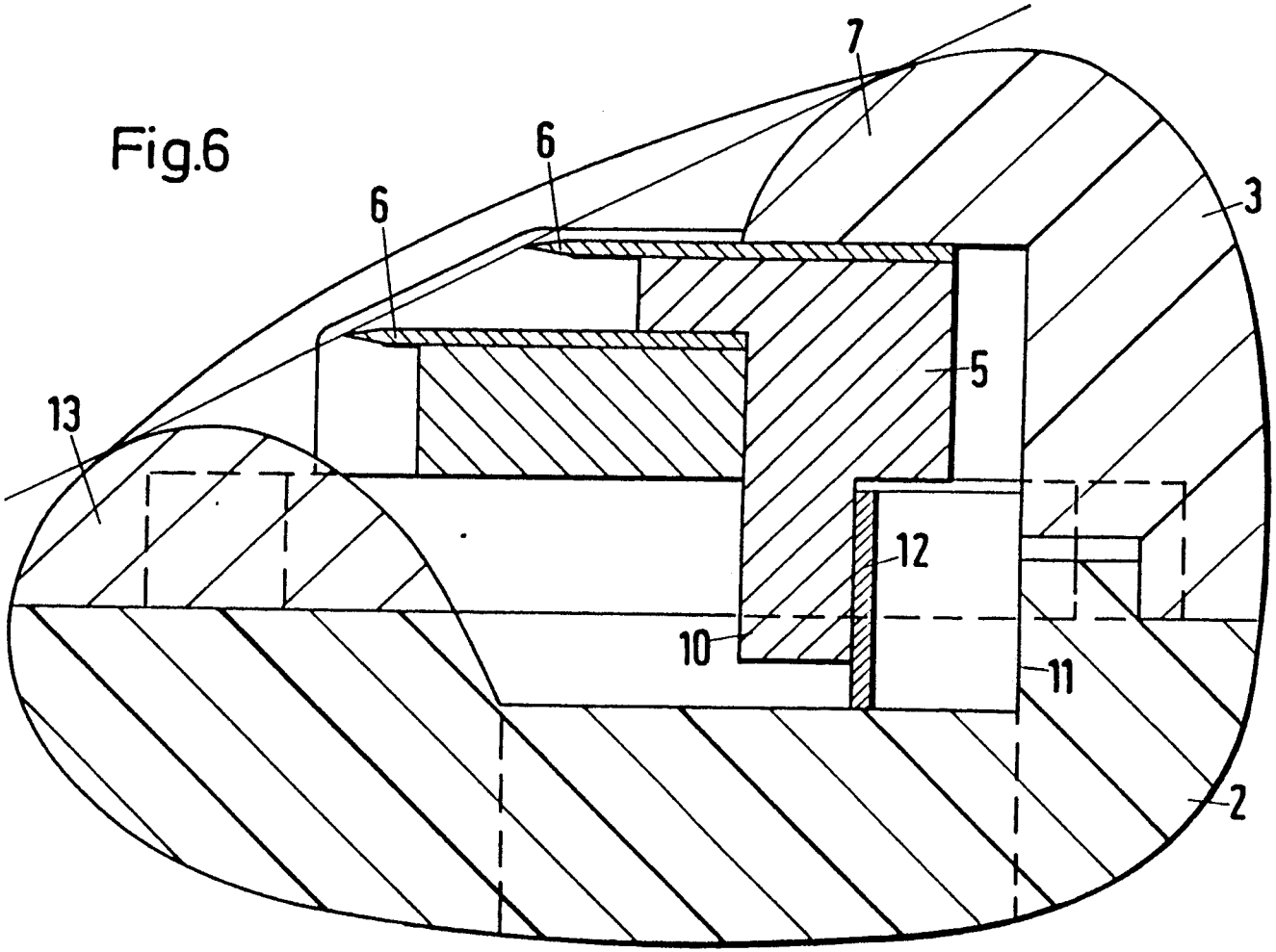
FIG. 6 is a cross-sectional view through the razor blade unit of FIG. 1 showing the blade member in the normal or starting position.
Figure 7:
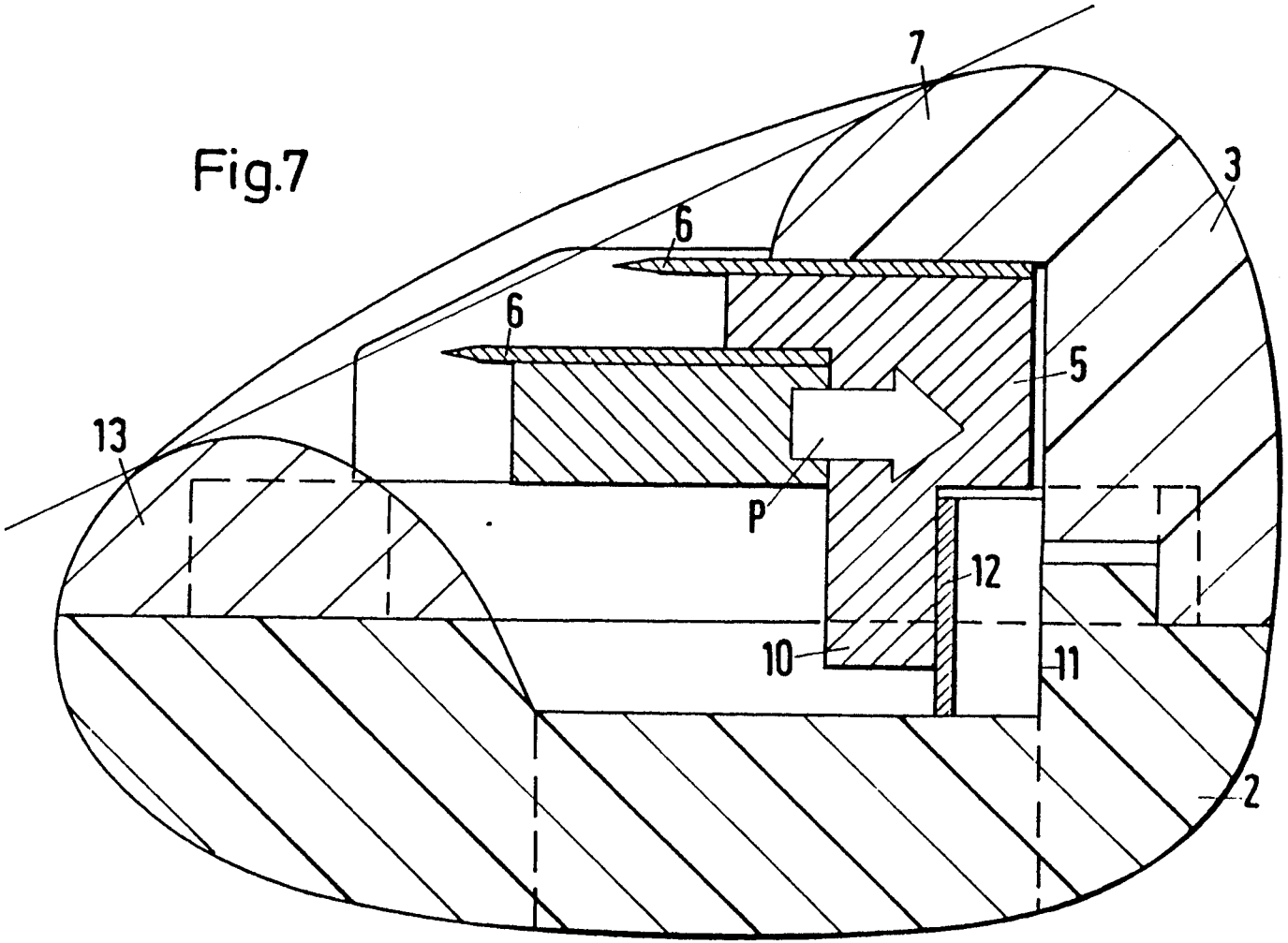
FIG. 7 is a cross-sectional view through the razor blade unit of FIG. 1, but shows the blade member shifted toward the rear.

As can be seen from the cross-sectional views of FIGS. 6 and 7, the underside of the blade member 5 is provided with a strip or bar 10. Supported between this strip 10 and the rear wall 11 of the plastic housing 1 is a compression spring 12 in the form of a leaf-type spring. This spring 12 has the tendency to press the blade member 5 toward the front in the direction of the guard or guide strip 13 of the plastic housing 1 as illustrated, for example, in FIG. 6. As can be seen from FIG. 2, the compression spring 12, which as previously indicated is in the form of a leaf-type spring, has a number of curved portions. In other words, in the illustrated embodiment 3 successively arranged curved portions are provided, so that the compression spring 12 rests against the rear wall 11 of the plastic housing 1 via two knees or junctures, and rests against the strip 10 of the blade member 5 via three points of curvature.

Figure 2:
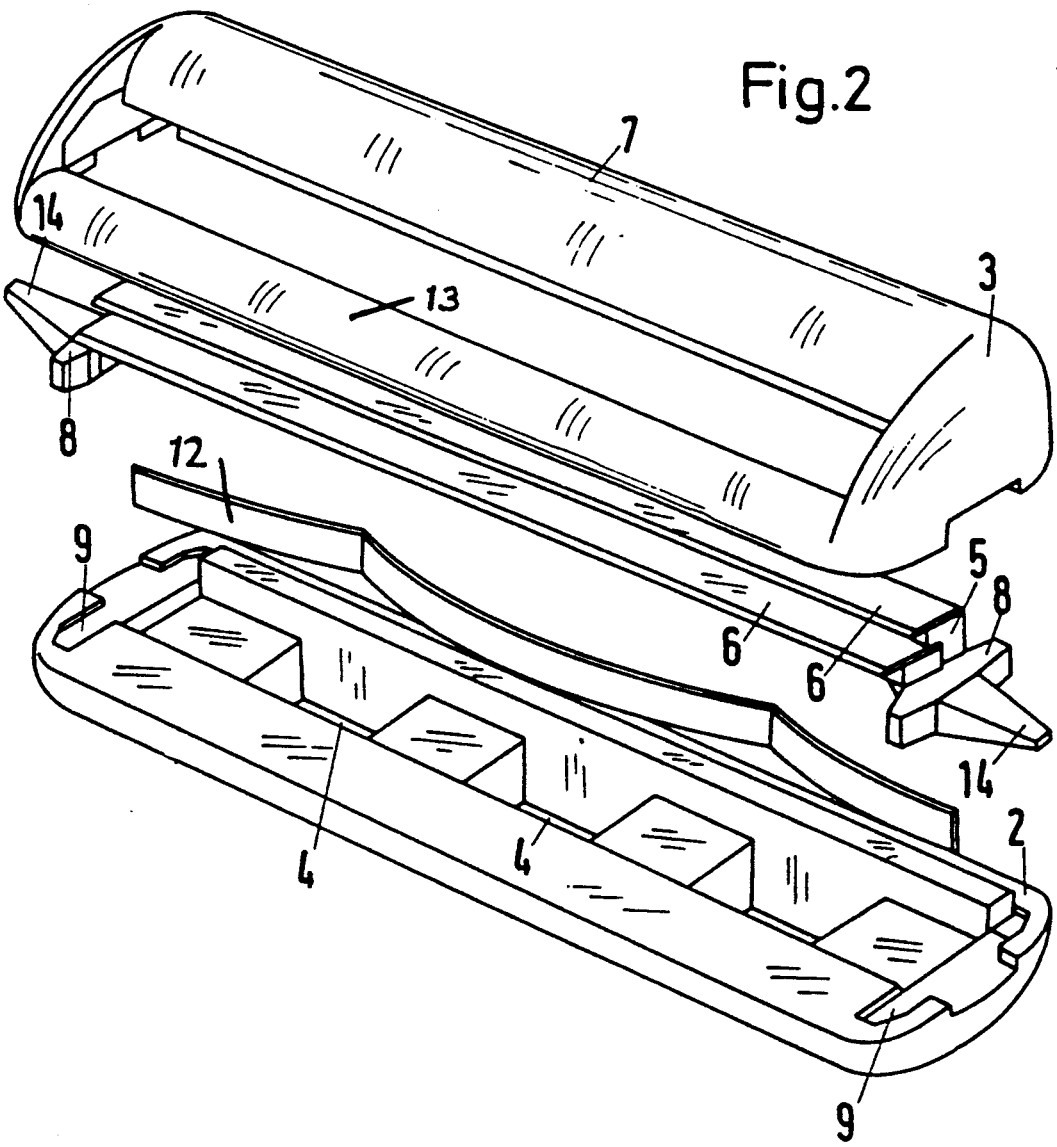
FIG. 2 is a partially exploded view of the razor blade unit of FIG. 1 prior to assembly.

As can furthermore be seen from FIG. 2, each side of the blade member 5 is provided with a respective projection 14 that is formed on the pertaining guide piece 8. These projections 14 of the blade member 5 extend through openings 15 in the side walls of the plastic housing 1 and are thereby controllable. After the lower portion 2 and the upper portion 3 have been joined together, recesses in the sides of the lower portion 2 and the upper portion 3 define the openings 15 in the side walls of the plastic housing 1.

Figure 3:
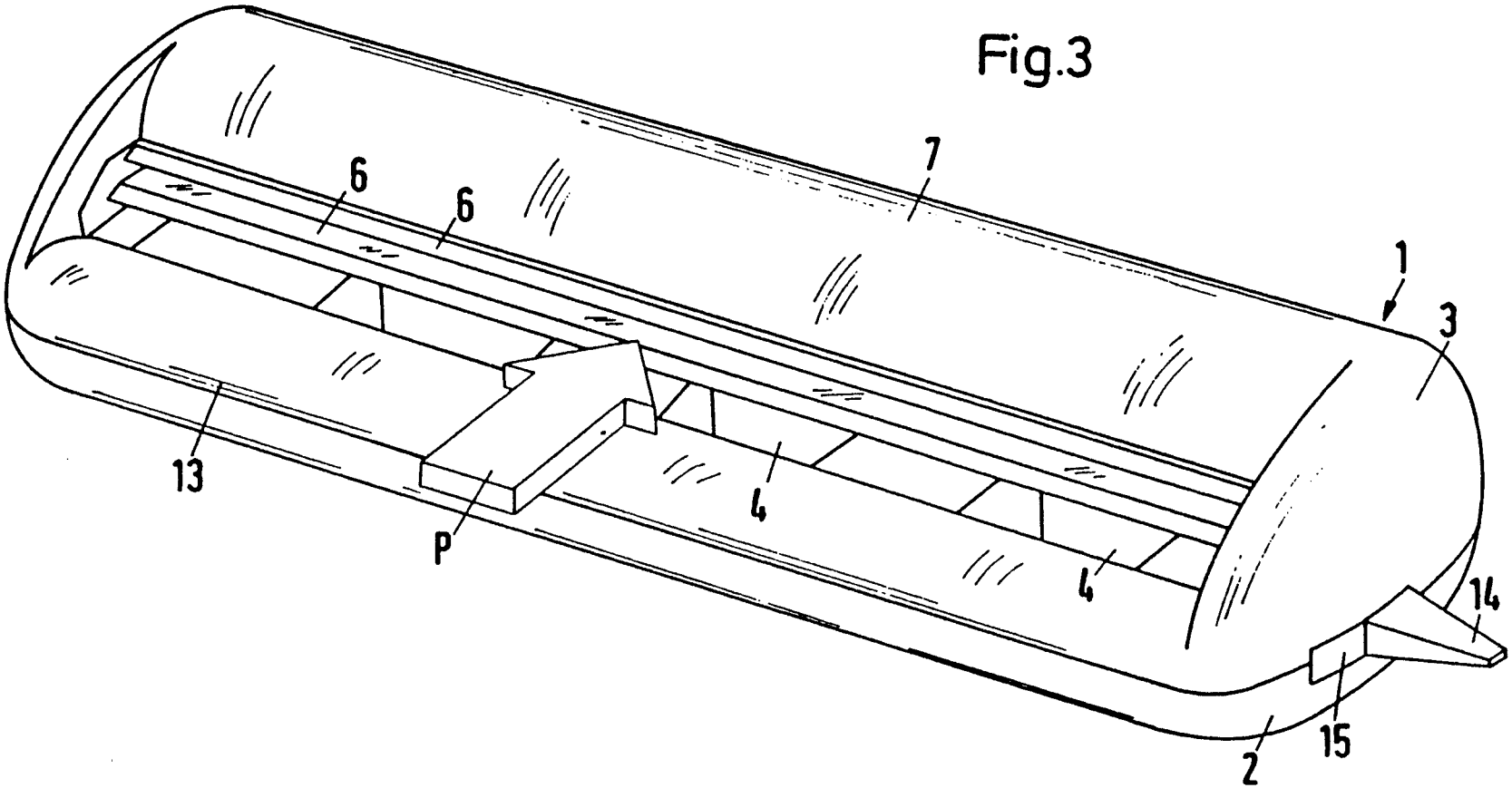
FIG. 3 is a view of the razor blade unit of FIG. 1 but with pressure being applied centrally to the blade member for an exact linear displacement of the blade member toward the rear.

The razor blade unit of the present invention operates as follows:

FIGS. 1 and 6 illustrate the normal or starting position of the razor blade unit, and in particular of the blade member 5 thereof. In other words, the blade member 5 is disposed in its forwardmost position, with the cutting edges of the razor blades 6 being disposed upon the tangent between the forward guide strip 13 and the rear cover means 7. If pressure is applied to the middle of the blade member 5, as shown in FIGS. 3 and 7 by the arrow P, the blade member 5, together with the razor blades 6 that are fixedly disposed thereon, move in a direction toward the rear wall 11 of the plastic housing 1. Involved is a true linear movement of the blade member 5, so that the blade member enters the plastic housing 1 in a uniform manner.

Figure 4:
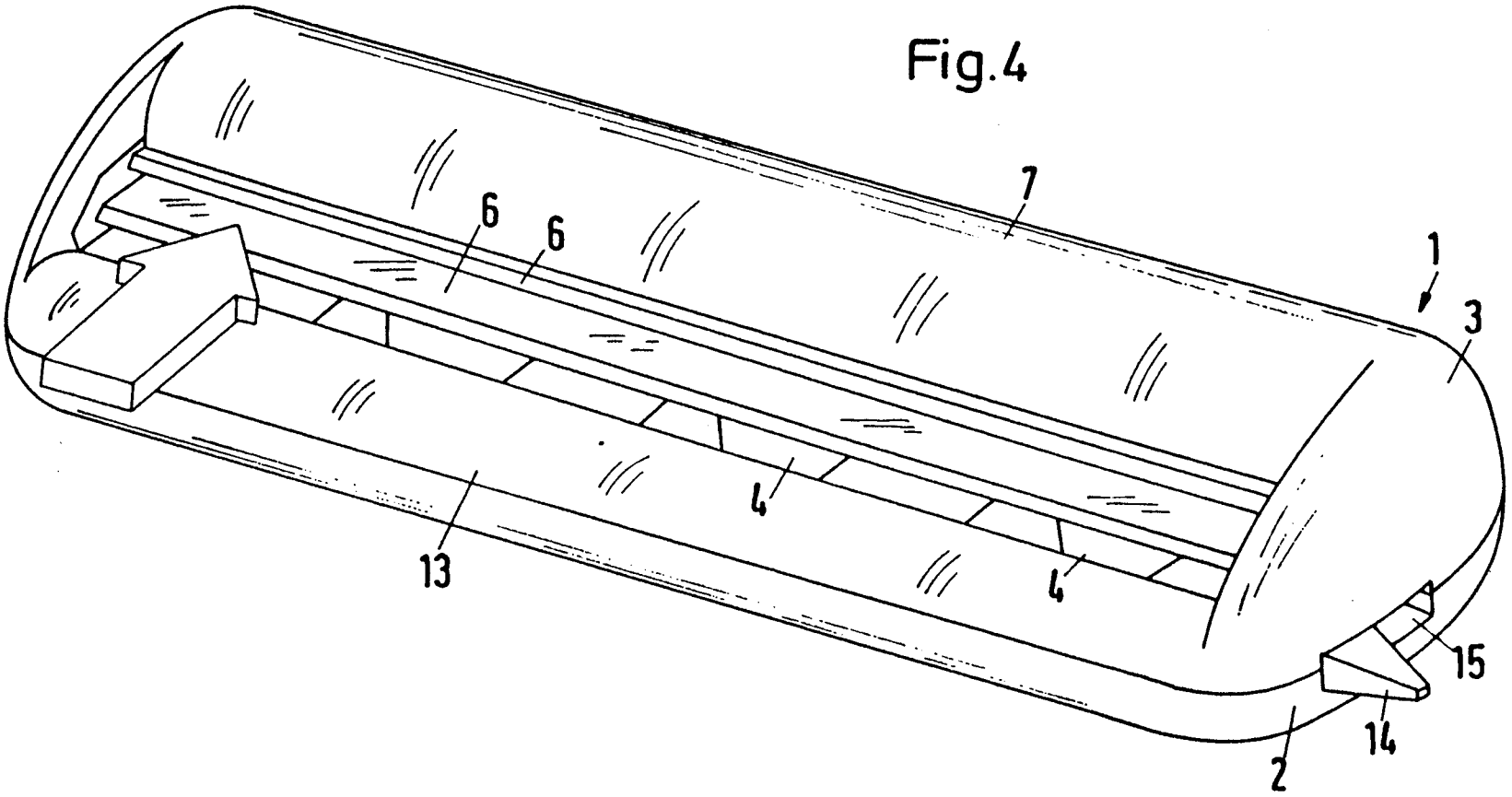
FIG. 4 is a view similar to FIG. 3, but with pressure being applied to the left side of the blade member so that the left portion of the blade member is shifted in a direction toward the rear wall of the plastic housing.
Figure 5:
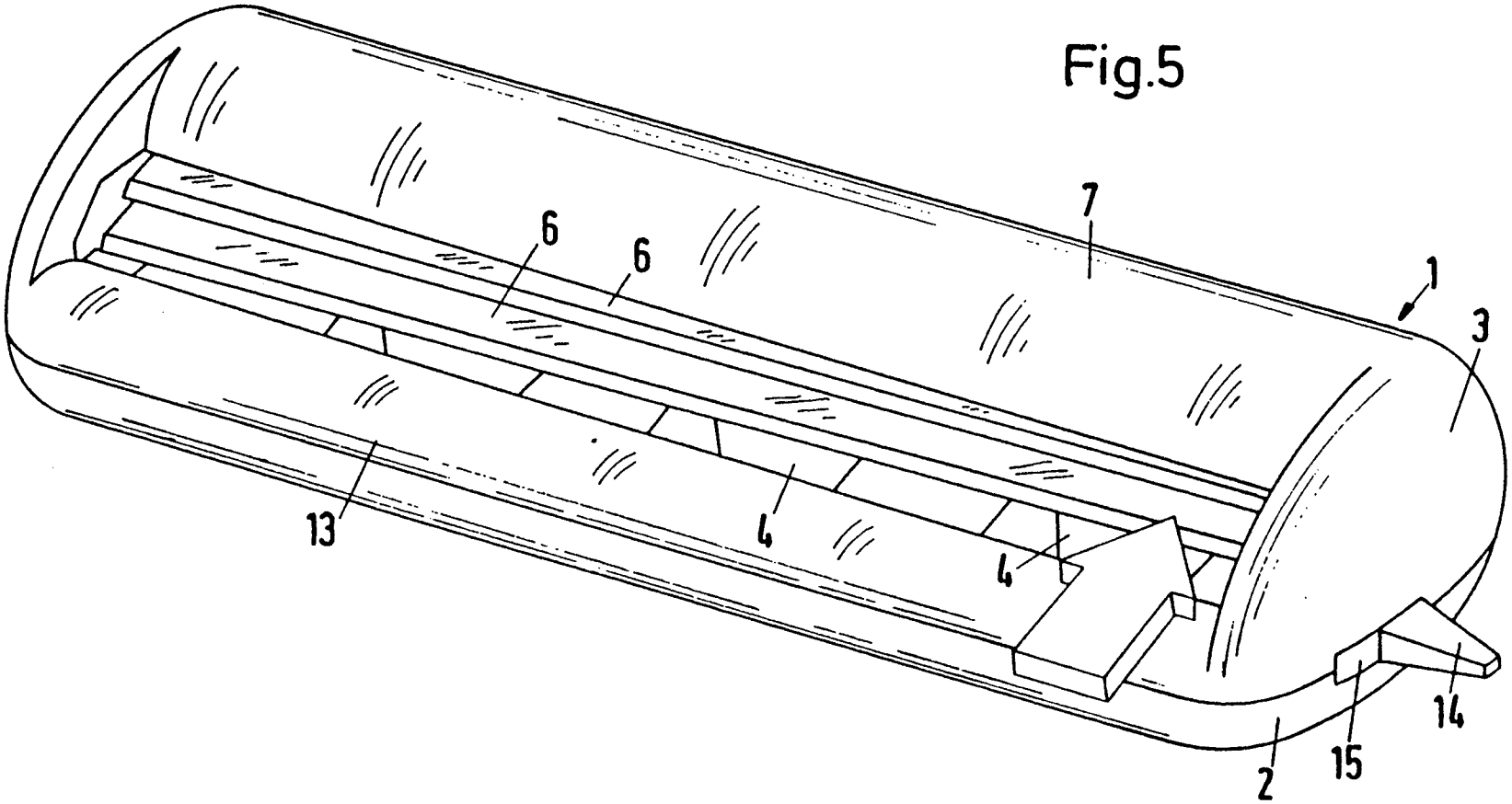
FIG. 5 is a view similar to FIG. 3, but with pressure being applied to the right side of the blade member so that the right portion of the blade member is shifted in a direction toward the rear wall of the plastic housing.

Alternatively, pressure can also be applied to the blade member 5 either on the left side (FIG. 4) or on the right side (FIG. 5). In a such a case, the blade member 5 would not be uniformly moved over its entire length in a direction toward the rear wall 11 of the plastic housing 1; rather, only that region where the application of pressure occurs, i.e. either on the left side (FIG. 4) or on the right side (FIG. 5) is moved toward the rear wall 11. In these situations, the blade member 5 carries out a kind of pivoting movement in the plane of the razor blades 6 about the opposite end, which acts as a fulcrum.

By means of the projections 14 that are provided at the ends of the blade member 5, the blade member can be manually shifted within the plastic housing to thereby enable improved cleaning of the razor blades 6.

The present invention is, of course, in no way restricted to the specific disclosure of the specification and drawings, but also encompasses any modifications within the scope of the appended claims.

What we claim is:

1. A razor head, especially a razor blade unit of a wet razor, with said razor head being disposed at an end of a handle and comprising:

a plastic housing having a rear wall;

a blade member to which razor blade means are secured, with said blade member being displaceably and yieldingly mounted in said plastic housing, and with said blade member having two oppositely disposed end, each of which is provided with a respective guide piece disposed in a corresponding recess in said plastic housing such as to permit said displacement of said blade member; and spring means disposed in said plastic housing for effecting said yielding mounting of said blade member, with said blade member being displaceable in a direction toward said rear wall of said plastic housing and parallel to a plane of said razor blade means against a spring force of said spring means.

2. A razor head according to claim 1, wherein said spring means comprises a number of curved portions over its length.

3. A razor head, especially a razor blade unit of a wet razor, with said razor head being disposed at an end of a handle and comprising:

a plastic housing having a rear wall;

a blade member to which razor blade means are secured, with said blade member being displaceably and yieldingly mounted in said plastic housing, and with said blade member having two oppositely disposed ends, each of which is provided with a respective guide piece disposed in a corresponding recess in said plastic housing such as to permit said displacement of said blade member; and spring means disposed in said plastic housing for effecting said yielding mounting of said blade member, with said blade member being displaceable in a direction toward said rear wall of said plastic housing against a spring force of said spring means.

4. A razor head according to claim 3, wherein said plastic housing includes a cover means having surface means for guiding a displacement movement of said blade member.

5. A razor head according to claim 3, wherein said spring means is a compression spring that is disposed between said blade member and said rear wall of said plastic housing.

6. A razor head according to claim 5, wherein said compression spring is a curved leaftype spring.

7. A razor head according to claim 5, wherein said compression spring is a wire spring.

8. A razor head according to claim 3, wherein said guide pieces are convexly curved on an outside surface.

9. A razor head according to claim 3, wherein said plastic housing comprises a lower portion and an upper portion that assemble together, with said blade member being disposed between said lower and upper portions as a separate component.

10. A razor head according to claim 9, wherein said lower portion of said plastic housing is provided with openings

11. A razor head according to claim 3, wherein said blade member is provided with at least one projection, which is guided outwardly through an opening in said plastic housing.

12. A razor head according to claim 11, wherein said at least one projection is provided on said guide piece of said blade member.

13. A razor head according to claim 11, wherein each of said ends of said blade member is provided with a respective one of said projections which are guided outwardly through corresponding openings in side walls of said plastic housing.

* * * * *